United States Patent [19]

Lehmann

[11] 4,338,737

[45] Jul. 13, 1982

[54] SAFETY CLIP-ON ORNAMENTAL BADGE

[76] Inventor: Roger W. Lehmann, 3 Beverly Dr., Belle Mead, N.J. 08502

[21] Appl. No.: 224,307

[22] Filed: Jan. 12, 1981

[51] Int. Cl.[3] ..... A44C 3/00

[52] U.S. Cl. ..... 40/1.5; 40/20 R

[58] Field of Search ..... 40/1.5, 1.6, 20 A, 20 R

[56] References Cited

U.S. PATENT DOCUMENTS

| | | | |
|---|---|---|---|
| D. 230,914 | 3/1974 | Marer | 33/185 R |
| 699,436 | 5/1902 | Ayers | 24/103 |
| 1,380,892 | 6/1921 | Gaunt | 40/1.5 |
| 1,990,935 | 2/1935 | Fallow | 40/1.5 |
| 2,341,121 | 2/1944 | Schaaf | 24/259 |
| 2,521,198 | 9/1950 | Adler | 63/20 |
| 2,874,495 | 2/1959 | Fowler | 40/1.5 |
| 2,902,782 | 9/1959 | Coleman | 40/1.5 |
| 3,054,201 | 9/1962 | Burns | 40/1.5 |
| 3,343,230 | 9/1967 | Darvie | 24/113 |
| 3,353,231 | 11/1967 | Levine | 24/113 |
| 3,931,688 | 1/1976 | Owens | 40/1.5 |
| 4,011,673 | 3/1977 | Levine | 278/68 |
| 4,096,655 | 6/1978 | Ullman, Jr. | 108/81 |
| 4,277,864 | 7/1981 | Orson | 40/1.5 |

*Primary Examiner*—Paul J. Hirsch
*Assistant Examiner*—John J. Wilson

[57] ABSTRACT

A clip-on ornamental badge for children, having two safety components, a soft badge and a safety clip removably and adjustably attached to the badge. The orientation of the badge relative to the clip, and of the clip relative to the badge, may be changed by rotating either relative to the other, whereby the badge may be clipped to differently oriented parts of a garment, and the badge may be adjusted to differently oriented positions. The same clip may be interchangeably applied to different badges.

3 Claims, 9 Drawing Figures

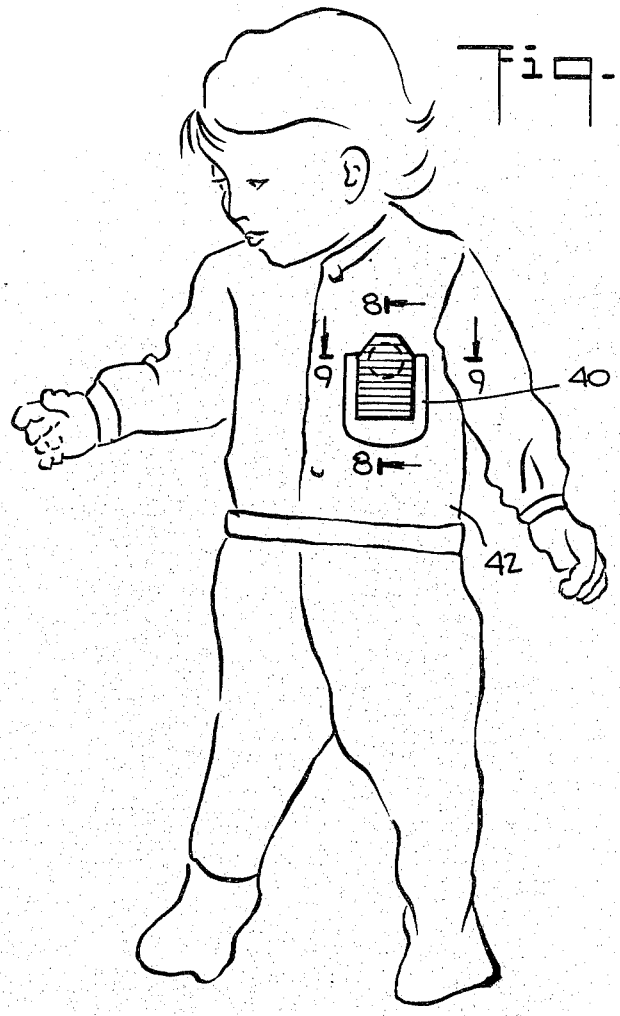
Fig. 1.
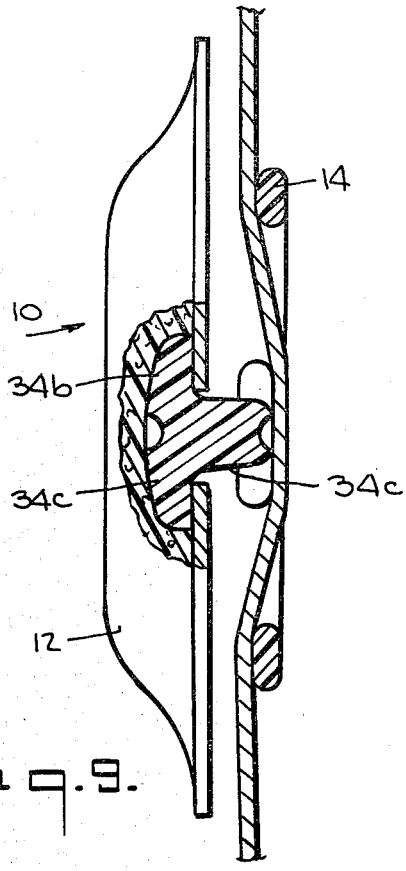
Fig. 9.
Fig. 8.
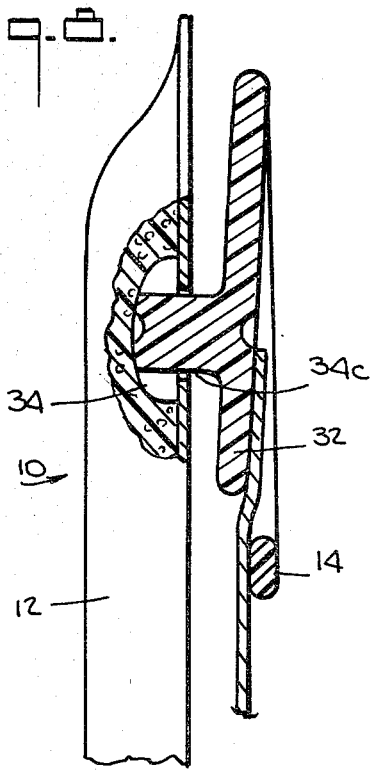
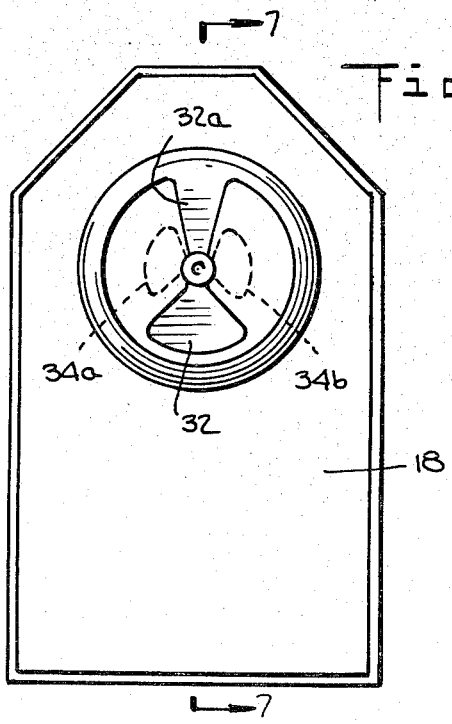
Fig. 6.

SAFETY CLIP-ON ORNAMENTAL BADGE

BACKGROUND OF THE INVENTION

1. Field of Invention

Ornamental badges clipped by children to pockets, lapels and other parts of garments.

2. Prior Art

The closest prior art known to applicant comprises the following U.S. patents:

U.S. Pat. No. 699,436—May 6, 1902—Ayers
U.S. Pat. No. 2,341,121—Feb. 8, 1944—Schaaff
U.S. Pat. No. 2,521,198—Sept. 5, 1950—Adler
U.S. Pat. No. 3,343,230—Sept. 26, 1967—Darvie
U.S. Pat. No. 3,353,231—Nov. 21, 1967—Levine
U.S. Pat. No. 4,011,673—Mar. 15, 1977—Levine
U.S. Pat. No. 4,096,655—June 27, 1978—Ullman, Jr.
Des. 230,914—Mar. 26, 1974—Marer But these prior art patents do not anticipate the present invention. Thus, Ayers uses a pin as the attaching means. This is not a safety device for children. Schaaff shows a paper clip with no means of attachment to a badge. Adler uses a pin as the attaching means. Darvie clips a cover to a button, and so does Levine U.S. Pat. No. 3,353,231. Levine U.S. Pat. No. 4,011,673 shows a paper clip, and so does Ullman, neither showing means for attaching a clip to a badge. Marer shows a button topper with no badge attaching means.

SUMMARY OF THE INVENTION

The principal object of this invention is the provision of a soft ornamental badge for children, having safety clip-on means which is both removably and adjustably secured to the badge.

The badge has an inner pocket and a buttonhole providing entrance into the pocket. The clip-on means is provided with a button-shaped stud which is insertable into said pocket through said buttonhole. The clip-on means is also provided with a safety clip for attachment to the lapel or pocket or other component of a garment.

The button-shaped stud coacting with the buttonhole and pocket provides the means of removably and adjustably attaching the clip-on means to the soft ornamental badge. The badge is free to rotate on the stud and the stud is free to be removed from the badge. Thus, no matter how the clip-on means may be oriented on the garment, the badge may be rotated to whatever position the wearer desires.

An important feature of the invention is the construction of the part that clips on to the garment. This part is a generally ring-shaped element having no sharp points which may be injurious to young children.

Although the invention is intended primarily for children and soft ornamental badges, it is applicable to analogous items such as identification badges.

The basic principle underlying the present invention as applied particularly to ornamental badges for children is the safety factor which is built into its component parts: a soft badge, a button-shaped connecting stud on the clip-on means, and a ring-shaped clip for attachment to a garment.

Another important feature of the invention resides in the molded plastic construction of the clip-on means. The button-shaped stud and the ring-shaped clip are integral parts of a single molding.

BRIEF DESCRIPTION OF THE DRAWING

FIG. 1 is a perspective view showing a child with a safety clip-on ornamental badge as herein described and claimed clipped on to a pocket of an outer garment.

FIG. 6 is a view of the back of the badge with the clip-on means secured thereto.

FIG. 8 is another enlarged fragmentary view partly in section showing the said badge with its clip-on means clipped to a pocket of a garment.

FIG. 9 is still another enlarged fragmentary view partly in section showing the said badge with its clip-on means attached to a garment pocket.

DESCRIPTION OF PREFERRED FORM OF INVENTION

Figure 5:
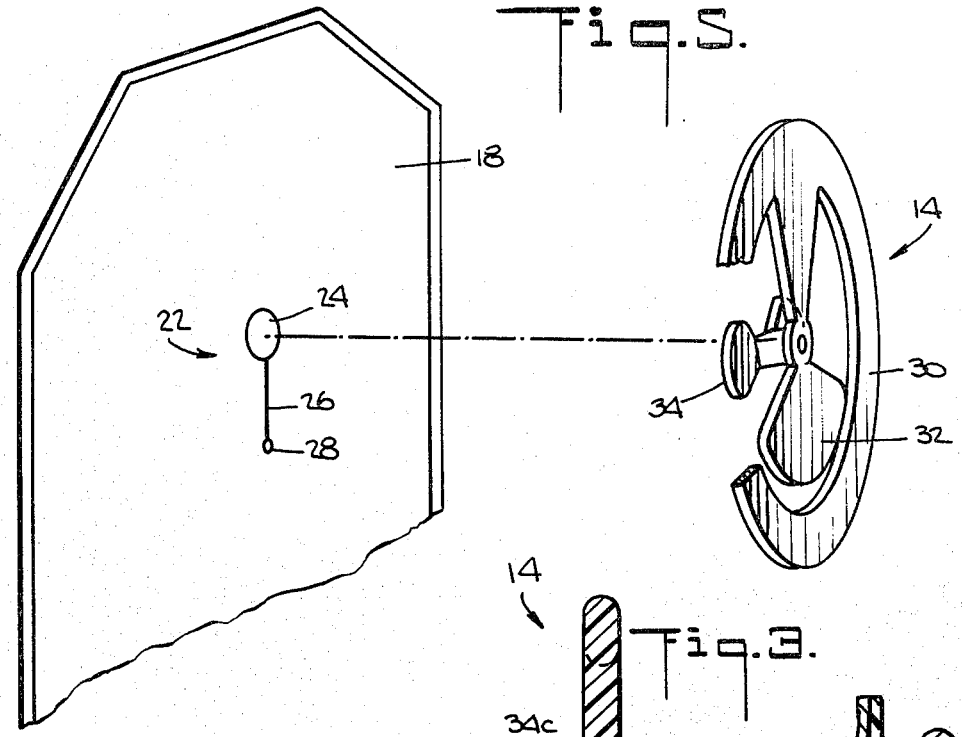
FIG. 5 is an exploded view, partly broken away and in section, showing the two parts of the clip-on ornamental badge, namely, the badge proper and the clip-on means.
Figure 3:
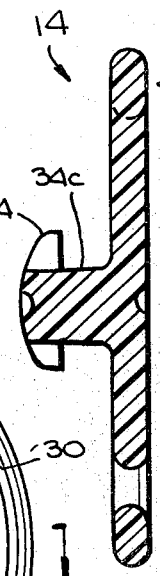
FIG. 3 is a diametric section on the line 3—3 of FIG. 2.
Figure 2:
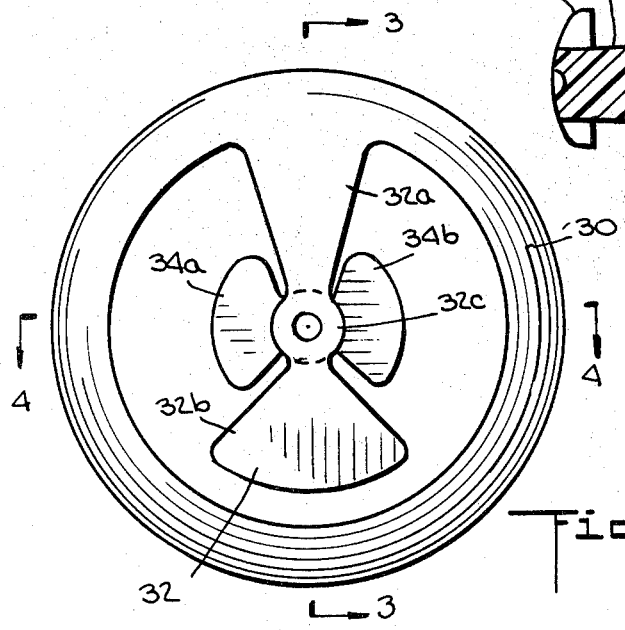
FIG. 2 is a face view of said clip-on ornamental badge.
Figure 4:
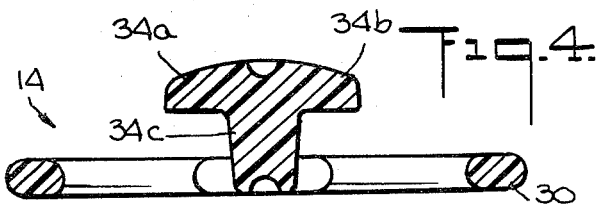
FIG. 4 is a diametric section taken on the line 4—4 of FIG. 2 and intersecting the section of FIG. 3 at right angles.

Safety clip-on ornamental badge 10 comprises two coacting components: a badge 12 and clip-on means 14. In the preferred form of the invention the badge is of soft construction to insure against injury to children. It comprises a front wall 16, a back wall 18 which is peripherally secured to the front wall, and a filler 20 occupying the space between the two walls. These walls are made of any suitable material such as sheet vinyl and the marginal edges of the walls are heat sealed or otherwise secured to each other to form a pocket for filler 20. This filler may consist of any material suited for the purpose such as foam plastics either molded or cut to the shape of the pocket.

An opening 22 is formed in the back wall 18 for insertion of a connecting part of the clip-on means 14, which connecting part will shortly be described. The opening is a modified form of keyhole slot and intended to perform substantially the same function as a keyhole slot, and, additionally, the function of a buttonhole as will shortly be apparent. Specifically, opening 22 comprises a circular hole 24 and a slit 26 extending radially from said hole. A smaller hole 28 is formed at the opposite end of the slit to widen the slit opening for insertion of the connecting part of the clip-on means. Hole 28 also performs the function of minimizing the tear factor at the end of the slit.

Clip-on means 14 is a plastic molding comprising a ring 30, a radial arm 32 extending inwardly from said ring in substantially the same plane, and a button-shaped stud 34 extending outwardly from radial arm 32, axially of the ring, and perpendicular to the ring and arm plane.

The precise configuration of arm 32 is not critical. As illustrated, it consists, essentially, of two sector-shaped parts **32*a* and 32*b* joined by a hub 32*c* which is centered in the ring. These sector-shaped parts provide the radial arm 32 with surface width for sufficient back-up engagement with a garment component such as a pocket 40 of child's garment 42**. The sector parts also provide ornamental design for an otherwise purely functional part.

Button-shaped stud 34 is also formed of a pair of sector-shaped parts 34*a* and 34*b* which are joined to an axial stud 34*c*. This stud 34*c* is, actually, an extension of hub 32*c*. Sector-shaped parts 34*a*, 34*b* perform the function of a button. Their shape and location relative to the shape and location of sector-shaped parts 32*a*, 32*b* of arm 32 are dictated to a large extent by molding requirements, parts 34*a* and 34*b* being offset from parts 32*a* and 32*b*.

Figure 7:
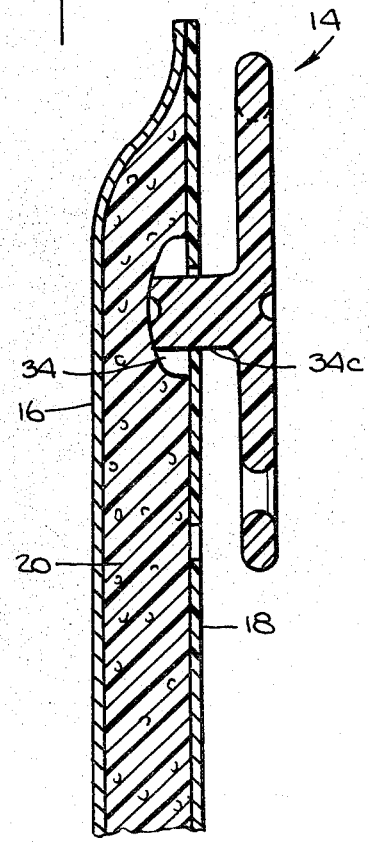
FIG. 7 is an enlarged fragmentary sectional view through said badge and its attached clip-on means, said view being taken on the line 7—7 of FIG. 6.

In the use of the present invention, button-shaped stud 34 is inserted through keyhole shaped opening 22 into the pocket defined by the walls of badge 12. In effect, the button-shaped stud 34 engages the keyhole-shaped buttonhole 22. The stud element 34*c* projects through hole 24 and sector-shaped parts 34*a*, 34*b* are positioned between wall 18 and foam filler 20. See FIG. 7. By reason of its resilience, foam filler presses against the sector-shaped parts 34*a*, 34*b* and holds same against the inner surface of wall 18. It will be apparent that the clip-on means 14 may be rotated relative to badge 12, but frictional engagement between sector-shaped parts 34*a*, 34*b* on the one hand, and foam filler 20 and wall 18 on the other hand, will hold the clip-on means and badge in whatever relative positions they are placed.

Attaching the badge and its clip-on means to a pocket 40 or other garment part is simple: the pocket is inserted between ring 30 and arm 32 of the clip-on means and the resilience of these parts will secure them to the pocket. See FIGS. 8 and 9. To insure sufficient resilience, the clip-on means is molded of suitable plastics, e.g., polypropylene. As will be understood, the operative clip parts of the invention are the ring 30 and the arm 32, neither of which provides sharp or otherwise potentially injurious parts. The ring provides 360 degrees of contact with the inner surface of a pocket or other garment part, and the arm provides diametric contact with the outer surface of the pocket or other garment part.

The foregoing is illustrative of the basic principles of the invention and it will be understood that modifications and variations of the illustrative form are fully contempled by applicant within the scope and limitations of the appended claims. For example, the precise shape of the badge and the clip-on means, as illustrated in the drawing, is not critical provided that any modifications thereof are capable of performing the functions of the invention as herein described. Similarly, different materials may be used to accomplish the same results.

I claim:

1. A clip-on badge, comprising:

(a) a badge (b) clip-on means, and (c) means for removably and adjustably attaching the clip-on means to the badge;

(d) said badge being provided with a buttonhole, and (e) said clip-on means being provided with a button-shaped stud which is engageable with said buttonhole to attach the clip-on means to the badge;

(f) the badge being formed of a pair of front and back walls which are peripherally secured to each other to define an inner pocket between them, (g) said buttonhole being formed in the back wall of said badge, (h) a resilient filler being disposed in the inner pocket between the front and back walls, and (i) the button-shaped stud being positioned between the back wall and the resilient filler, (j) whereby the button-shaped stud is frictionally secured in place between the resilient filler and the back wall by reason of the resilient pressure applied to it by the resilient filler.

2. A clip-on badge in accordance with claim 1, wherein:

(a) the buttonhole provided in the badge is substantially of keyhole shape.

(b) comprising a generally circular hole, and (c) a slit extending radially from said hole.

3. A clip-on badge in accordance with claim 1, wherein:

(a) the clip-on means comprises a ring, and (b) a radial arm extending inwardly from said ring, (c) said ring and arm occupying a substantially common plane, (d) said button-shaped stud being connected with said radial arm and extending axially of the ring.

* * * * *